US009934789B2

(12) United States Patent
Kim et al.

(10) Patent No.: US 9,934,789 B2
(45) Date of Patent: Apr. 3, 2018

(54) METHOD, MEDIUM, AND APPARATUS WITH SCALABLE CHANNEL DECODING

(75) Inventors: Junghoe Kim, Seoul (KR); Eunmi Oh, Seoul (KR); Kihyun Choo, Seoul (KR); Miao Lei, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 906 days.

(21) Appl. No.: 11/652,031

(22) Filed: Jan. 11, 2007

(65) Prior Publication Data

US 2007/0233296 A1 Oct. 4, 2007

Related U.S. Application Data

(60) Provisional application No. 60/757,857, filed on Jan. 11, 2006, provisional application No. 60/758,985, filed on Jan. 17, 2006, provisional application No. 60/759,543, filed on Jan. 18, 2006, provisional application No. 60/789,147, filed on Apr. 5, 2006, provisional application No. 60/789,601, filed on Apr. 6, 2006.

(30) Foreign Application Priority Data

May 30, 2006 (KR) ..... 10-2006-0049033

(51) Int. Cl.
*H04R 5/00* (2006.01)
*G10L 19/24* (2013.01)
*G10L 19/008* (2013.01)

(52) U.S. Cl.
CPC ..... *G10L 19/24* (2013.01); *G10L 19/008* (2013.01)

(58) Field of Classification Search
USPC ..... 381/1, 22, 23, 119; 369/3, 4
See application file for complete search history.

(56) References Cited

U.S. PATENT DOCUMENTS

| | | | |
|---|---|---|---|
| 5,524,054 | A | 6/1996 | Spille |
| 5,850,456 | A | 12/1998 | Ten Kate et al. |
| 7,006,636 | B2 | 2/2006 | Baumgarte et al. |
| 7,068,792 | B1 | 6/2006 | Surazski et al. |
| 7,359,522 | B2 | 4/2008 | Aarts et al. |

(Continued)

FOREIGN PATENT DOCUMENTS

| | | | |
|---|---|---|---|
| CN | 1647158 | A | 7/2005 |
| CN | 1669359 | A | 9/2005 |

(Continued)

OTHER PUBLICATIONS

Extended European Search Report issued by the European Patent Office dated Jan. 1, 2010 in correspondence to European Patent Application No. 07708487.9.

(Continued)

*Primary Examiner* — Duc Nguyen
*Assistant Examiner* — Kile Blair
(74) *Attorney, Agent, or Firm* — Sughrue Mion, PLLC

(57) ABSTRACT

A method, medium, and apparatus with scalable channel decoding. The method includes recognizing the configuration of channels or speakers, calculating the respective number of same path decoding levels for each multi-channel signal using the recognized configuration of the channels or speakers, and performing decoding and up-mixing according to the calculated respective number of decoding levels.

5 Claims, 8 Drawing Sheets

(56) References Cited

U.S. PATENT DOCUMENTS

| | | | | |
|---|---|---|---|---|
| 7,487,097 | B2 | 2/2009 | Engdegard et al. | |
| 7,573,912 | B2 * | 8/2009 | Lindblom | G10L 19/008 370/252 |
| 7,711,552 | B2 | 5/2010 | Villemoes | |
| 7,876,904 | B2 | 1/2011 | Ojala et al. | |
| 7,987,097 | B2 | 7/2011 | Pang et al. | |
| 8,150,042 | B2 * | 4/2012 | Van Loon et al. | 381/23 |
| 8,204,261 | B2 * | 6/2012 | Allamanche | H04S 3/02 381/309 |
| 2002/0006081 | A1 | 1/2002 | Fujishita | |
| 2002/0154900 | A1 | 10/2002 | Shimada | |
| 2003/0026441 | A1 | 2/2003 | Faller | |
| 2003/0219130 | A1 | 11/2003 | Baumgarte et al. | |
| 2003/0236583 | A1 | 12/2003 | Baumgarte et al. | |
| 2004/0117193 | A1 | 6/2004 | Kawai | |
| 2005/0053249 | A1 | 3/2005 | Wu et al. | |
| 2005/0135643 | A1 | 6/2005 | Lee et al. | |
| 2005/0157883 | A1 | 7/2005 | Herre et al. | |
| 2005/0195981 | A1 | 9/2005 | Faller et al. | |
| 2005/0271213 | A1 | 12/2005 | Kim | |
| 2005/0276420 | A1 * | 12/2005 | Davis | 381/20 |
| 2005/0281408 | A1 | 12/2005 | Kim et al. | |
| 2006/0106620 | A1 * | 5/2006 | Thompson et al. | 704/500 |
| 2006/0206323 | A1 | 9/2006 | Breebaart | |
| 2007/0081597 | A1 | 4/2007 | Disch et al. | |
| 2007/0160218 | A1 | 7/2007 | Jakka et al. | |
| 2007/0189426 | A1 | 8/2007 | Kim et al. | |
| 2008/0008327 | A1 | 1/2008 | Ojala et al. | |
| 2010/0087097 | A1 | 4/2010 | Hogue et al. | |

FOREIGN PATENT DOCUMENTS

| | | | |
|---|---|---|---|
| CN | 101647158 | A | 2/2010 |
| JP | 11-225390 | | 8/1999 |
| JP | 2001-352599 | | 12/2001 |
| JP | 2004-194100 | | 7/2004 |
| JP | 2004-312484 | | 11/2004 |
| JP | 2005-069274 | | 3/2005 |
| JP | 2005-094125 | | 4/2005 |
| JP | 2005-098826 | | 4/2005 |
| JP | 2005-101905 | | 4/2005 |
| KR | 1996-0039668 | | 11/1996 |
| KR | 2001-0086976 | | 9/2001 |
| KR | 10-2002-0018730 | | 3/2002 |
| KR | 10-2002-0082117 | | 10/2002 |
| KR | WO 03/028407 | | 4/2003 |
| KR | 2004-78183 | | 3/2004 |
| KR | 10-2005-0115801 | | 12/2005 |
| KR | 10-2006-0047444 | | 5/2006 |
| KR | 10-2006-0049941 | | 5/2006 |
| KR | 10-2006-0109299 | | 10/2006 |
| KR | 10-2007-0005469 | | 1/2007 |
| KR | 10-2007-0035411 | | 3/2007 |
| KR | 10-2007-0078398 | | 7/2007 |
| KR | 10-2007-0080850 | | 8/2007 |
| KR | 10-0763919 | | 9/2007 |
| WO | 02/07481 | | 1/2002 |
| WO | 2004/008805 | | 1/2004 |
| WO | WO 2004019656 | A2 * | 3/2004 |
| WO | 2004-097794 | | 11/2004 |
| WO | 2005/036925 | | 4/2005 |
| WO | 2005/101370 | | 10/2005 |
| WO | 2007/080212 | | 7/2007 |

OTHER PUBLICATIONS

Breebart, J. et al. "MPEG Spatial Audio Coding/MPEG Surround: Overview and Current Status" In: Proc. 119th AES Convention, New York, Oct. 2005.

International Search Report dated Apr. 12, 2007 in corresponding International Patent Application No. PCT/KR2007/000201.

U.S. Appl. No. 11/652,687, filed Jan. 12, 2007, Sangchul Ko et al., Samsung Electronics Co., Ltd.

U.S. Appl. No. 11/707,990, filed Feb. 20, 2007, Junghoe Kim et al., Samsung Electronics Co., Ltd.

PCT International Search Report dated Jun. 12, 2007 in corresponding Korean PCT Patent Application No. PCT/KR2007/001066.

Scheirer, E.D. et al., "AudioBIFS: Describing Audio Scenes with the MPEG-4 Multimedia Standard," IEEE Transactions on Multimedia, Sep. 1999, vol. 1, No. 3, pp. 237-250.

PCT International Search Report dated Jun. 14, 2007 for International Patent Application No. PCT/KR2007/001067.

Korean Non-Final Rejection dated Jul. 18, 2011 corresponds to Korean Patent Application No. 10-2011-0056345.

Korean Notice of Allowance dated Jul. 26, 2011 corresponds to Korean Patent Application No. 10-2007-0067134.

Japanese Office Action dated Feb. 15, 2011 corresponds to Chinese Patent Application No. 2008-550237.

J. Herre et al., The Reference Model Architecture for MPEG Spatial Audio Coding, Audio Engineering Society Convention Paper 6447, USA, Audio Engineering Society, May 28, 2005.

Japanese Office Action dated Jun. 7, 2011 corresponds to Japanese Patent Application No. 2008-550238.

Notice of Allowance dated Aug. 29, 2007 in Korean Application No. 10-2006-0075301.

Notice of Last Non-Final Rejection dated Feb. 27, 2013 in Korean Application No. 10-2012-0064601.

Notice of Preliminary Reexamination dated Feb. 19, 2013 in Japanese Application No. 2008-550238.

Breebaart Jeroen, et al. "The Reference Model Architecture for MPEG Spatial Audio Coding", AES Convention 118 May 2005, AES, 60 East 42nd Street, Room 2520 New York.

Japanese Final Rejection dated Jul. 24, 2012 in Japanese Application No. 2008-550238.

Korean Notice of Allowance dated Sep. 28, 2012 in Korean Application No. 10-2012-0083520.

Korean Office Action dated Aug. 14, 2012 in Korean Application No. 10-2011-0056345.

Korean Notice of Allowance dated Sep. 28, 2012 in Korean Application No. 10-2006-0049034.

European Search report dated Sep. 10, 2012 in European Application No. 12002670.3-2225.

ISO/IEC JTC 1/SC 29/WG 11 N7983, "Coding of Moving Pictures and Audio", Apr. 2006, Montreux.

ISO/IEC JTC1/SC29/WG 11 MPEG2005/M12886, "Coding of Moving Pictures and Audio", Jan. 2006, Bangkok, Thailand.

ISO/IEC JTC 1/SC 29/WG 11 N7530 "Coding of Moving Pictures and Audio", Oct. 2005, Nice, France.

Korean Notice of Allowance dated Sep. 20, 2007 corresponds to Korean Patent Application No. 10-2006-0109523.

Extended European Search Report dated Feb. 5, 2010 corresponds to European Application No. 07715470.6-2225.

Korean Non-Final Rejection dated Dec. 3, 2012 in Korean Application No. 10-2012-0108275.

Extended European Search Report dated Dec. 3, 2012 in European Patent Application No. 12164460.3-2225.

Office Action dated Nov. 28, 2012 in related U.S. Appl. No. 11/707,990.

Office Action dated Sep. 10, 2012 in related U.S. Appl. No. 11/707,990.

Korean Non-Final Rejection dated Jun. 27, 2012 corresponds to Korean Patent Application No. 10-2012-0064601.

Korean Non-Final Rejection dated Apr. 30, 2012 corresponds to Korean Patent Application No. 10-2006-0049034.

U.S. Office Action dated Mar. 27, 2013 in copending U.S. Appl. No. 11/652,687.

U.S. Office Action dated Nov. 7, 2011 in copending U.S. Appl. No. 11/652,687.

U.S. Office Action dated Jun. 1, 2011 in copending U.S. Appl. No. 11/652,687.

U.S. Office Action dated Oct. 5, 2010 in copending U.S. Appl. No. 11/652,687.

U.S. Office Action dated Mar. 2, 2011 in copending U.S. Appl. No. 11/707,990.

U.S. Office Action dated Dec. 19, 2011 in copending U.S. Appl. No. 11/707,990.

(56) References Cited

OTHER PUBLICATIONS

U.S. Office Action dated Feb. 14, 2014 in U.S. Appl. No. 11/652,687.
Korean Office Action dated Jul. 30, 2013 in Korean Patent Application No. 10-2012-0108275.
Korean Office Action dated Jul. 30, 2013 in Korean Patent Application No. 10-2012-0064601.
European Search report dated Jul. 16, 2012 in European Patent Application No. 12170289.8-2225.
European Search report dated Jul. 16, 2012 in European Patent Application No. 12170294.8-2225.
U.S. Notice of Allowance dated Aug. 26, 2013 in copending U.S. Appl. No. 11/707,990.
Korean Office Action dated Oct. 24, 2013 in Korean Patent Application No. 10-2012-0108275.
Korean Office Action dated Oct. 24, 2013 in Korean Patent Application No. 10-2012-0064601.
Japanese Office Action dated Jun. 11, 2013 in Japanese Patent Application No. 2012-253715.
U.S. Notice of Allowance dated Jul. 8, 2014 in U.S. Appl. No. 11/652,687.
Communication dated Jan. 20, 2015 issued by The State Intellectual Property Office of People's Republic of China in counterpart Chinese Application No. 201210459124.7.
Communication from the State Intellectual Property Office of P.R. China dated Apr. 23, 2015 in a counterpart Chinese application No. 201210458826.3.
Communication dated Sep. 14, 2016 issued by the State Intellectual Property Office of P.R. China in counterpart Chinese Patent Application No. 201210457153.X.
Audio Subgroup, "Text of second working draft for MPEG Surround", International Organization for Standardization, Organisation Internationale Normalisation, ISO/IEC JTC 1/SC 29/WG 11, Coding of Moving Pictures and Audio, No. N7387, Jul. 25, 2005, Poznan, Poland, ISO/IEC WD 23003-1, XP030013965, total 140 pages.
Communication dated Nov. 10, 2016, issued by the European Patent Office in counterpart European Application No. 12164460.3.

* cited by examiner

FIG. 9

```
for(i=0;i<Tree_outChan[v];i++) {
    if(bPlaySpk[ioffset[v]+i]==0)
        for(j=0;j<Tree_depth [v][i];j++)
            Tree_sign [v][j][i]=0;   /* 0 denotes 'n/a' */
            IsPruningFinish[v][i]=0;
}
for(i= numRow-1;i >=0;i--) {
    for(j=0;j<Tree_outChan[v];j++) {
        if(bPlaySpk[ioffset[v]+j]==0 || IsPruningFinish[v][i]==1)
            continue;
        if(IsFindSameInTreesign())
            IsPruningFinish[v][i]=1;
        else
            Tree_sign [v][i][j]=0;
    }
}
```

FIG. 10

```
/*to determine the pruned OTT index with DL(0,) */
for(i=0;i<numOTTBox;i++)  /* for 5-1-5 configuration, numOTTBox=5 */
        isOTTPruned[i] = 0;
for(i=0;i<Tree_cutChan[0];i++) {
        if(DL[0][i]!= Tree_depth[0][i] && DL[0][i]!=-1) {
                for(j=DL[0][i];j< Tree_depth[0][i];j++) {
                        if(!isOTTPruned[Tree[0][j][i]])
                                isOTTPruned[Tree[0][j][i]] = 1;
                }
        }
}
for(i=0;i<numOTTBox;i++) {
        if(isOTTPruned[i] == 1){
                if(IsCenterLFE(i)) {
                        c_l[i] = 1;
                        c_r[i] = 1;
                }
                else {
                        H11[i] = 1;
                        H21[i] = 1;
                        H12[i] = 0;
                        H22[i] = 0;
                }
        }
}
```

IsPruningFinish[ ] : a variable for indicating if the pruning is finished for every output ch channel. The '0' means the pruning is not finished and the '1' means the pruning is finished.

numRow : the number of row in $\mathbf{Tree}_{sign}(v,)$

IsFindSameInTreesign() : a function to check if the same $\mathbf{Tree}_{sign}(v, 0:i-1, k)$ where $k \neq j$ with $\mathbf{Tree}_{sign}(v, 0:i-1, j)$ is found in current tree. The '0' means there is no same vector and the '1' means the same vector is not founded.

METHOD, MEDIUM, AND APPARATUS WITH SCALABLE CHANNEL DECODING

CROSS-REFERENCE TO RELATED APPLICATIONS

This application claims the benefits of U.S. Provisional Patent Application No. 60/757,857, filed on Jan. 11, 2006, U.S. Provisional Patent Application No. 60/758,985, filed on Jan. 17, 2006, U.S. Provisional Patent Application No. 60/759,543, filed on Jan. 18, 2006, U.S. Provisional Patent Application No. 60/789,147, filed on Apr. 5, 2006, U.S. Provisional Patent Application No. 60/789,601, filed on Apr. 6, 2006, in the U.S. Patent and Trademark Office, and Korean Patent Application No. 10-2006-0049033, filed on May 30, 2006, in the Korean Intellectual Property Office, the disclosures of which are incorporated herein in their entirety by reference.

BACKGROUND

1. Field of the Invention

One or more embodiments of the present invention relate to audio coding, and more particularly, to surround audio coding for an encoding/decoding for multi-channel signals.

2. Description of the Related Art

Multi-channel audio coding can be classified into waveform multi-channel audio coding and parametric multi-channel audio coding. Waveform multi-channel audio coding can be classified into moving picture experts group (MPEG)-2 MC audio coding, AAC MC audio coding, and BSAC/AVS MC audio coding, where 5 channel signals are encoded and 5 channel signals are decoded. Parametric multi-channel audio coding includes MPEG surround coding, where the encoding generates 1 or 2 encoded channels from 6 or 8 multi-channels, and then the 6 or 8 multi-channels are decoded from the 1 or 2 encoded channels. Here, such 6 or 8 multi-channels are merely examples of such a multi-channel environment.

Generally, in such multi-channel audio coding, the number of channels to be output from a decoder is fixed by encoder. For example, in MPEG surround coding, an encoder may encode 6 or 8 multi-channel signals into the 1 or 2 encoded channels, and a decoder must decode the 1 or 2 encoded channels to 6 or 8 multi-channels, i.e., due to the staging of encoding of the multi-channel signals by the encoder all available channels are decoded in a similar reverse order staging before any particular channels are output. Thus, if the number of speakers to be used for reproduction and a channel configuration corresponding to positions of the speakers in the decoder are different from the number of channels configured in the encoder, sound quality is degraded during up-mixing in the decoder.

According to the MPEG surround specification, multi-channel signals can be encoded through a staging of down-mixing modules, which can sequentially down-mix the multi-channel signals ultimately to the one or two encoded channels. The one or two encoded channels can be decoded to the multi-channel signal through a similar staging (tree structure) of up-mixing modules. Here, for example, the up-mixing stages initially receive the encoded down-mixed signal(s) and up-mix the encoded down-mixed signal(s) to multi-channel signals of a Front Left (FL) channel, a Front Right (FR) channel, a Center (C) channel, a Low Frequency Enhancement (LFE) channel, a Back Left (BL) channel, and a Back Right (BR) channel, using combinations of 1-to-2 (OTT) up-mixing modules. Here, the up-mixing of the stages of OTT modules can be accomplished with spatial information (spatial cues) of Channel Level Differences (CLDs) and/or Inter-Channel Correlations (ICCs) generated by the encoder during the encoding of the multi-channel signals, with the CLD being information about an energy ratio or difference between predetermined channels in multi-channels, and with the ICC being information about correlation or coherence corresponding to a time/frequency tile of input signals. With respective CLDs and ICCs, each staged OTT can up-mix a single input signal to respective output signals through each staged OTT. See FIGS. 4-8 as examples of staged up-mixing tree structures according to embodiments of the present invention.

Thus, due to this requirement of the decoder having to have a particular staged structure mirroring the staging of the encoder, and due to the conventional ordering of down-mixing, it is difficult to selectively decode encoded channels based upon the number or speakers to be used for reproduction or a corresponding channel configuration corresponding to the positions of the speakers in the decoder.

SUMMARY

One or more embodiments of the present invention set forth a method, medium, and apparatus with scalable channel decoding, wherein a configuration of channels or speakers in a decoder is recognized to calculate the number of levels to be decoded for each multi-channel signal encoded by an encoder and to perform decoding according to the calculated number of levels.

Additional aspects and/or advantages of the invention will be set forth in part in the description which follows and, in part, will be apparent from the description, or may be learned by practice of the invention.

To achieve at least the above and/or other aspects and advantages, an embodiment of the present invention includes a method for scalable channel decoding, the method including setting a number of decoding levels for at least one encoded multi-channel signal, and performing selective decoding and up-mixing of the at least one encoded multi-channel signal according to the set number of decoding levels such that when the set number of decoding levels is set to indicate a full number of decoding levels all levels of the at least one encoded multi-channel signal are decoded and up-mixed and when the set number of decoding levels is set to indicate a number of decoding levels different from the full number of decoding levels not all available decoding levels of the at least one encoded multi-channel signal are decoded and up-mixed.

To achieve at least the above and/or other aspects and advantages, an embodiment of the present invention includes at least one medium including computer readable code to control at least one processing element to implement an embodiment of the present invention.

To achieve at least the above and/or other aspects and advantages, an embodiment of the present invention includes an apparatus with scalable channel decoding, the apparatus including a level setting unit to set a number of decoding levels for at least one encoded multi-channel signal, and an up-mixing unit to perform selective decoding and up-mixing of the at least one encoded multi-channel signal according to the set number of decoding levels such that when the set number of decoding levels is set to indicate a full number of decoding levels all levels of the at least one encoded multi-channel signal are decoded and up-mixed and when the set number of decoding levels is set to indicate a number of decoding levels different from the full number of decoding levels not all available decoding levels of the at least one encoded multi-channel signal are decoded and up-mixed.

To achieve at least the above and/or other aspects and advantages, an embodiment of the present invention includes a method for scalable channel decoding, the method including recognizing a configuration of channels or speakers for a decoder, and selectively up-mixing at least one down-mixed encoded multi-channel signal to a multi-channel signal corresponding to the recognized configuration of the channels or speakers.

To achieve at least the above and/or other aspects and advantages, an embodiment of the present invention includes a method for scalable channel decoding, the method including recognizing a configuration of channels or speakers for a decoder, setting a number of modules through which respective up-mixed signals up-mixed from at least one down-mixed encoded multi-channel signal pass based on the recognized configuration of the channels or speakers, and performing selective decoding and up-mixing of the at least one down-mixed encoded multi-channel signal according to the set number of modules.

To achieve at least the above and/or other aspects and advantages, an embodiment of the present invention includes a method for scalable channel decoding, the method including recognizing a configuration of channels or speakers for a decoder, determining whether to decode a channel, of a plurality of channels represented by at least one down-mixed encoded multi-channel signal, based upon availability of reproducing the channel by the decoder, determining whether there are multi-channels to be decoded in a same path except for a multi-channel that is determined not to be decoded by the determining of whether to decode the channel, calculating a number of decoding and up-mixing modules through which each multi-channel signal has to pass according to the determining of whether there are multi-channels to be decoded in the same path except for the multi-channel that is determined not to be decoded, and performing selective decoding and up-mixing according to the calculated number of decoding and up-mixing modules.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 9 illustrates a pseudo code for setting $Tree_{sign}(v,)$ using a method, medium, and apparatus with scalable channel decoding, according to an embodiment of the present invention; and FIG. 10 illustrates a pseudo code for removing a component of a matrix or of a vector corresponding to an unnecessary module using a method, medium, and apparatus with scalable channel decoding, according to an embodiment of the present invention.

DETAILED DESCRIPTION

Figure 1:
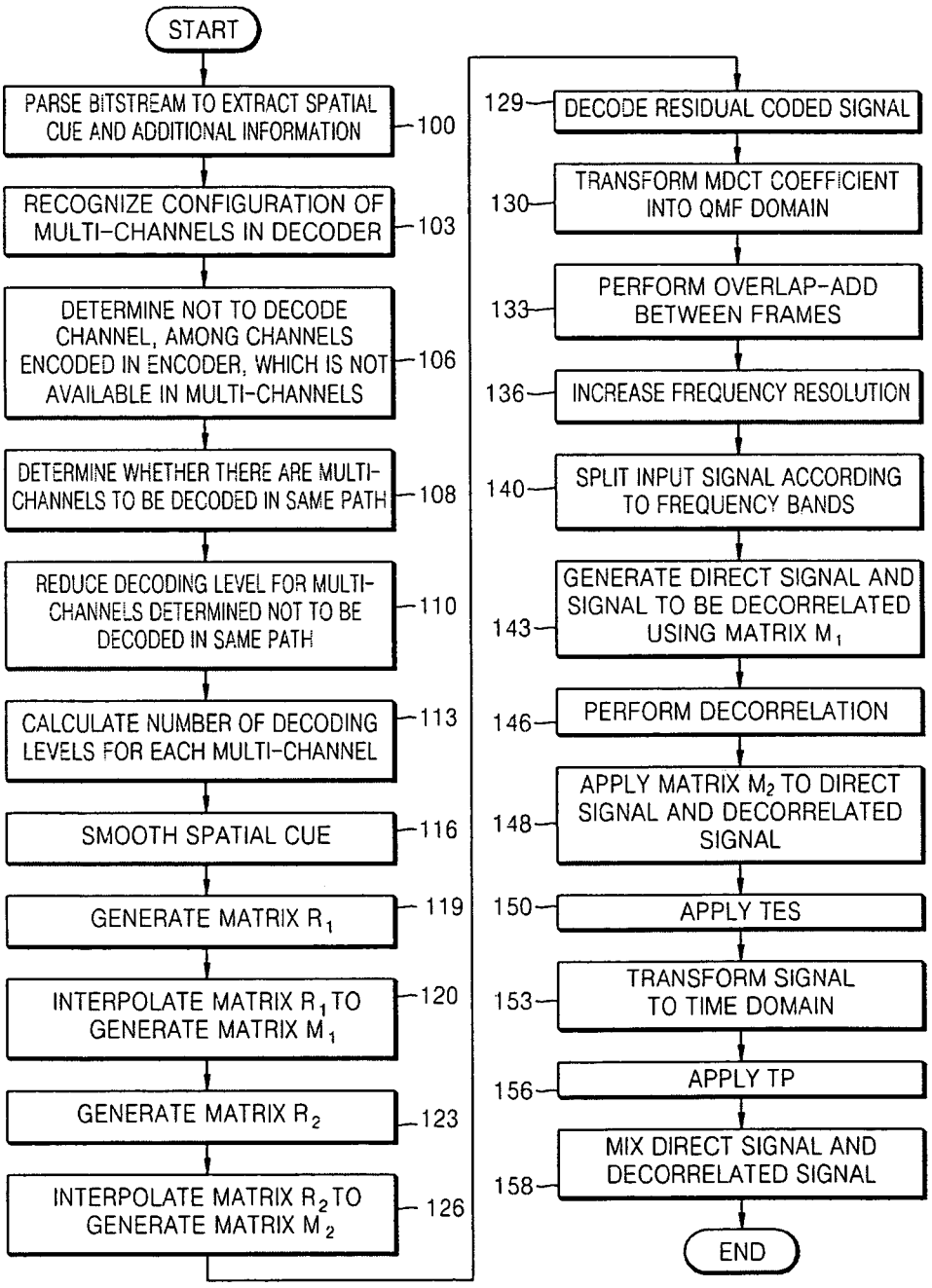
FIG. 1 illustrates a multi-channel decoding method, according to an embodiment of the present invention.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 illustrating a multi-channel decoding method, according to an embodiment of the present invention.

First, a surround bitstream transmitted from an encoder is parsed to extract spatial cues and additional information, in operation 100. A configuration of channels or speakers provided in a decoder is recognized, in operation 103. Here, the configuration of multi-channels in the decoder corresponds to the number of speakers included/available in/to the decoder (below referenced as "numPlayChan"), the positions of operable speakers among the speakers included/available in/to the decoder (below referenced as "playChanPos(ch)"), and a vector indicating whether a channel encoded in the encoder is available in the multi-channels provided in the decoder (below referenced as "bPlaySpk(ch)").

Here, bPlaySpk(ch) expresses, among channels encoded in the encoder, a speaker that is available in multi-channels provided in the decoder using a '1', and a speaker that is not available in the multi-channels using a '0', as in the below Equation 1, for example.

$$bPlaySpk(i) = \begin{cases} 1, & \text{if the loudspeaker position of } i^{th} \\ & \text{output channel} \in playChanPos \\ 0, & \text{otherwise} \end{cases} \quad \text{Equation 1}$$

for $0 \le i \le numOutChanAT$

Similarly, the referenced numOutChanAT can be calculated with the below Equation 2.

$$numOutChaAT = \sum_{k=0}^{numOutChan-1} Tree_{OutChan}(k) \quad \text{Equation 2}$$

Further, the referenced playChanPos can be expressed for, e.g., a 5.1 channel system, using the below Equation 3.

playChanPos=[FL FR C LFE BL BR] Equation 3:

In operation 106, it may be determined to not decode a channel that is not available in the multi-channels, for example.

A matrix $Tree_{sign}(v,)$ may include components indicating whether each output signal is to be output to an upper level of an OTT module (in which case, the component is expressed with a '1') or whether each output signal is to be output to a lower level of the OTT module (in which case the component is expressed with a '−1'), e.g., as in tree structures illustrated in FIGS. 3 through 8. In the matrix $Tree_{sign}(v,)$, v is greater than 0 and less than numOutChan. Hereinafter, embodiments of the present invention will be described using the matrix $Tree_{sign}(v,)$, but it can be understood by those skilled in the art that embodiments of the present invention can be implemented without being limited to such a matrix $Tree_{sign}(v,)$. For example, a matrix that is obtained by exchanging rows and columns of the matrix $Tree_{sign}(v,)$ may be used, noting that alternate methodologies for implementing the invention may equally be utilized.

Figure 4:
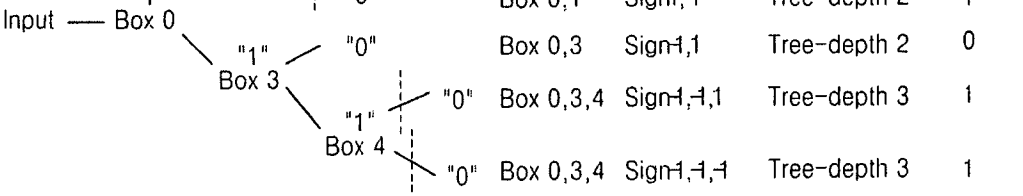
FIG. 4 illustrates a predetermined tree structure for explaining a method, medium, and apparatus with scalable channel decoding, according to an embodiment of the present invention.

For example, in a tree structure illustrated in FIG. 4, in a matrix $Tree_{sign}$, a first column to be output to an upper level from Box 0, an upper level from Box 1, and an upper level from Box 2 is indicated by [1 1 1], and a fourth column to be output to a lower level from Box 0 and an upper level from Box 3 is indicated by [−1 1 n/a]. Here, 'n/a' is an identifier indicating a corresponding channel, module, or box is not available. In this way, all multi-channels can be expressed with $Tree_{sign}$ as follows:

$$Tree_{sign} = \begin{pmatrix} 1 & 1 & 1 & -1 & -1 & -1 \\ 1 & 1 & -1 & 1 & -1 & -1 \\ 1 & -1 & n/a & n/a & 1 & -1 \end{pmatrix}$$

In operation 106, a column corresponding to a channel that is not available in the multi-channels provided in the decoder, among the channels encoded in the encoder, are all set to 'n/a' in the matrix $Tree_{sign}(v,)$.

For example, in the tree structure illustrated in FIG. 4, the vector bPlaySpk, indicating whether a channel encoded in the encoder is available in the multi-channels provided in the decoder, is expressed with a '0' in a second channel and a fourth channel. Thus, the second channel and the fourth channel among the multi-channels provided in the decoder are not available in the multi-channels provided in the decoder. Thus, in operation 106, a second column and a fourth column corresponding to the second channel and the fourth channel are set to n/a in the matrix $Tree_{sign}$, thereby generating $Tree'_{sign}$.

$$Tree'_{sign} = \begin{pmatrix} 1 & n/a & 1 & n/a & -1 & -1 \\ 1 & n/a & -1 & n/a & -1 & -1 \\ 1 & n/a & n/a & n/a & 1 & -1 \end{pmatrix}$$

In operation 108, it is determined whether there are multi-channels to be decoded in the same path, except for the channel that is determined not to be decoded in operation 106. In operation 108, on the assumption that predetermined integers j and k are not equal to each other in a matrix $Tree_{sign}$ (v,i,j) set in operation 106, it is determined whether $Tree_{sign}(v,0{:}i-1,j)$ and $Tree_{sign}$ (v,0:i−1,k) are the same in order to determine whether there are multi-channels to be decoded in the same path.

For example, in the tree structure illustrated in FIG. 4, since $Tree_{sign}(v,0{:}1,1)$ and $Tree_{sign}$ (v,0:1,3) are not the same as each other, a first channel and a third channel in the matrix $Tree'_{sign}$ generated in operation 106 are determined as multi-channels that are not to be decoded in the same path in operation 108. However, since $Tree_{sign}(v,0{:}1,5)$ and $Tree_{sign}$ (v,0:1,6) are the same as each other, fifth channel and a sixth channel in the matrix $Tree'_{sign}$ generated in operation 106 are determined as multi-channels that are to be decoded in the same path in operation 108.

In operation 110, a decoding level is reduced for channels determined as multi-channels that are not to be decoded in the same path in operation 108. Here, the decoding level indicates the number of modules or boxes for decoding, like an OTT module or a 2-to-3 (TTT) module, through which a signal has to pass to be output from each of the multi-channels. A decoding level that is finally determined for channels determined as multi-channels that are not to be decoded in the same path in operation 108 is expressed as n/a.

For example, in the tree structure illustrated in FIG. 4, since the first channel and the third channel are determined as multi-channels that are not to be decoded in the same path in operation 108, the last row of a first column corresponding to the first channel and the last row of a third column corresponding to the third channel are set to n/a as follows:

$$Tree'_{sign} = \begin{pmatrix} 1 & n/a & 1 & n/a & -1 & -1 \\ 1 & n/a & -1 & n/a & -1 & -1 \\ n/a & n/a & n/a & n/a & 1 & -1 \end{pmatrix}$$

Operations 108 and 110 may be repeated while the decoding level is reduced one-by-one. Thus, operations 108 and 110 can be repeated from the last row to the first row of $Tree_{sign}(v,)$ on a row-by-row basis.

In operations 106 through 110, $Tree_{sign}(v,)$ may be set for each sub-tree using a pseudo code, such as that illustrated in FIG. 9.

In operation 113, the number of decoding levels may be calculated for each of the multi-channels using the result obtained in operation 110.

The number of decoding levels may be calculated according to the following Equation 4.

$$DL(v) = [\, dl_{i_{offset}(v)} \quad dl_{i_{offset}(v)+1} \quad \cdots \quad dl_{i_{offset}(v)+Tree_{outChan}(v)-1} \,] \qquad \text{Equation 4}$$

$$\text{where } i_{offset}(v) = \begin{cases} \sum_{k=0}^{v-1} Tree_{outChan}(k), & v > 0 \\ 0 & \text{otherwise} \end{cases}, \; 0 <= v < numOutChan$$

$$dl_{i_{offset}(v)+i} = \begin{cases} \sum_{j=0}^{Tree_{depth}(v,1)-1} \text{abs}(Tree_{sign}(v,\, j,\, i)), & \text{if } bPlaySpk[i] \text{ is equal to } 1 \\ -1, & \text{otherwise} \end{cases},$$

for $0 \le i < Tree_{outChan}(v)$, $0 \le v < numOutChan$ where $\text{abs}(n/a) = 0$, $$i_{offset}(v) = \begin{cases} \sum_{k=0}^{v-1} Tree_{outChan}(k), & v > 0 \\ 0 & \text{otherwise} \end{cases}$$

For example, in the tree structure illustrated in FIG. 4, the number of decoding levels of the matrix $Tree'_{sign}$, set in operation 110, may be calculated as follows:

$$DL=[2\ -1\ 2\ -1\ 3\ 3]$$

Since the absolute value of n/a is assumed to be 0 and a column whose components are all n/a is assumed to be −1, the sum of absolute values of components of the first column in the matrix $Tree'_{sign}$ is 2 and the second column whose components are all n/a in the matrix $Tree'_{sign}$ is set to −1.

By using the DL calculated as described above, modules before a dotted line illustrated in FIG. 4 perform decoding, thereby implementing scalable decoding.

In operation 116, spatial cues extracted in operation 100 may be selectively smoothed in order to prevent a sharp change in the spatial cues at low bitrates.

In operation 119, for compatibility with a conventional matrix surround techniques, a gain and pre-vectors may be calculated for each additional channel and a parameter for compensating for a gain for each channel may be extracted in the case of the use of an external downmix at the decoder, thereby generating a matrix $R_1$. $R_1$ is used to generate a signal to be input to a decorrelator for decorrelation.

Figure 5:
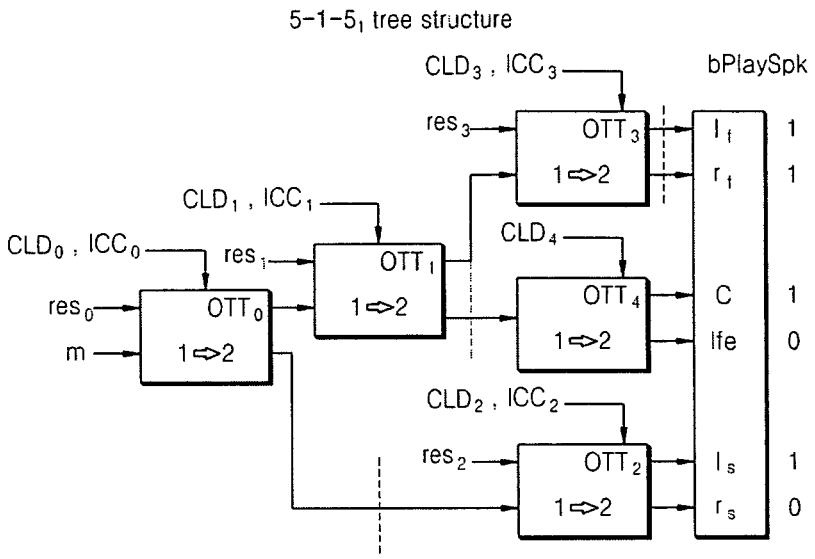
FIG. 5 illustrates 4 channels being output in a 5-1-$5_1$ tree structure, according to an embodiment of the present invention.
Figure 6:
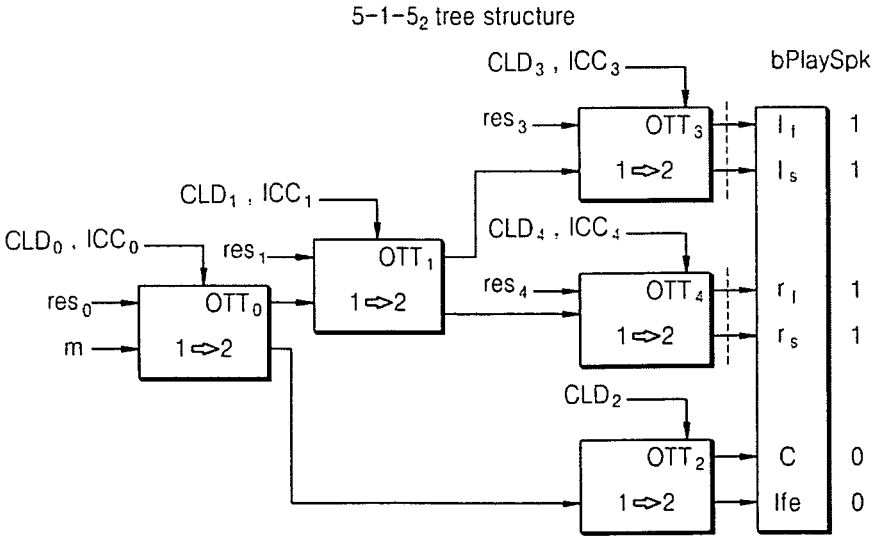
FIG. 6 illustrates 4 channels being output in a 5-1-$5_2$ tree structure, according to an embodiment of the present invention.

For example, in this embodiment it will be assumed that a 5-1-$5_1$ tree structure, illustrated in FIG. 5, and a 5-1-$5_2$ tree structure, illustrated in FIG. 6, are set to the following matrices.

$$\mathrm{Tree}(0,,) = \begin{bmatrix} 0 & 0 & 0 & 0 & 0 & 0 \\ 1 & 1 & 1 & 1 & 2 & 2 \\ 3 & 3 & 4 & 4 & n/a & n/a \end{bmatrix},$$

$$Tree_{sign}(0,,) = \begin{bmatrix} 1 & 1 & 1 & 1 & -1 & -1 \\ 1 & 1 & -1 & -1 & 1 & -1 \\ 1 & -1 & 1 & -1 & n/a & n/a \end{bmatrix},$$

$$Tree_{depth}(0,) = [3\ \ 3\ \ 3\ \ 3\ \ 2\ \ 2],$$

$$Tree_{outChan}(0) = [6].$$

In this case, in the 5-1-$5_1$ tree structure, $R_1$ is calculated as follows, in operation 119.

$$R_1^{l,m} = \begin{bmatrix} 1 \\ 1 \\ K1 \\ K2 \\ K3 \end{bmatrix}, \text{ where } K1 = \begin{cases} c_{1,OTT_0}^{l,m}, & \sum_{i=0}^{3} DL(0,i) != -4 \\ 0, & \text{otherwise} \end{cases}$$

$$K2 = \begin{cases} c_{1,OTT_0}^{l,m} c_{1,OTT_1}^{l,m}, & DL(0,0) = 3, \\ & DL(0,1) = 3 \\ 0, & \text{otherwise} \end{cases},$$

$$K3 = \begin{cases} c_{2,OTT_0}^{l,m}, & DL(0,4) = 2, DL(0,5) = 2 \\ 0, & \text{otherwise} \end{cases}$$

-continued

, where $$c_{1,OTT_X}^{l,m} = \sqrt{\frac{10^{\frac{CLD_X^{l,m}}{10}}}{1 + 10^{\frac{CLD_X^{l,m}}{10}}}} \text{ and } c_{2,OTT_X}^{l,m} = \sqrt{\frac{1}{1 + 10^{\frac{CLD_X^{l,m}}{10}}}}, |$$

and where:

$$CLD_X^{l,m} = D_{CLD}(X, l, m), 0 \le X < 2, 0 \le m < M_{proc}, 0 \le l < L.$$

In this case, in the 5-1-$5_2$ tree structure, $R_1$ may be calculated as follows, in operation 119.

$$R_1^{l,m} = \begin{bmatrix} 1 \\ 1 \\ K1 \\ K2 \\ K3 \end{bmatrix}, \text{ where } K1 = \begin{cases} c_{1,OTT_0}^{l,m}, & \sum_{i=0}^{3} DL(0,i) != -4 \\ 0, & \text{otherwise} \end{cases}$$

$$K2 = \begin{cases} c_{1,OTT_0}^{l,m} c_{1,OTT_1}^{l,m}, & DL(0,0) = 3, \\ & DL(0,1) = 3 \\ 0, & \text{otherwise} \end{cases},$$

$$K3 = \begin{cases} c_{2,OTT_0}^{l,m} c_{2,OTT_1}^{l,m}, & DL(0,2) = 3, \\ & DL(0,3) = 3 \\ 0, & \text{otherwise} \end{cases}$$

$$\text{, where } c_{1,OTT_X}^{l,m} = \sqrt{\frac{10^{\frac{CLD_X^{l,m}}{10}}}{1 + 10^{\frac{CLD_X^{l,m}}{10}}}} \text{ and } c_{2,OTT_X}^{l,m} = \sqrt{\frac{1}{1 + 10^{\frac{CLD_X^{l,m}}{10}}}},$$

and where:

$$CLD_X^{l,m} = D_{CLD}(X, l, m), 0 \le X < 2, 0 \le m < M_{proc}, 0 \le l < L$$

In operation 120, the matrix $R_1$ generated in operation 119 is interpolated in order to generate a matrix $M_1$.

In operation 123, a matrix $R_2$ for mixing a decorrelated signal with a direct signal may be generated. In order for a module determined as an unnecessary module, in operations 106 through 113, not to perform decoding, the matrix $R_2$ generated in operation 123 removes a component of a matrix or of a vector corresponding to the unnecessary module using a pseudo code, such as that illustrated in FIG. 10.

Hereinafter, examples for application to the 5-1-$5_1$ tree structure and the 5-1-$5_2$ tree structure will be described.

First, FIG. 5 illustrates the case where only 4 channels are output in the 5-1-$5_1$ tree structure. If operations 103 through 113 are performed for the 5-1-$5_1$ tree structure illustrated in FIG. 5, $Tree'_{sign}(0,,)$ and DL(0,) are generated as follows:

$$Tree'_{sign}(0,,) = \begin{bmatrix} 1 & 1 & 1 & n/a & -1 & n/a \\ 1 & 1 & -1 & n/a & n/a & n/a \\ 1 & -1 & n/a & n/a & n/a & n/a \end{bmatrix},$$

$$DL(0,) = [3\ \ 3\ \ 2\ \ -1\ \ 1\ \ -1].$$

Decoding is stopped in a module before the illustrated dotted lines by the generated DL(0,). Thus, since OTT2 and OTT4 do not perform up-mixing, the matrix $R_2$ can be generated in operation 126 as follows:

$$R_2^{l,m} = \begin{bmatrix} H11_{OTT_3}^{l,m} H11_{OTT_1}^{l,m} H11_{OTT_0}^{l,m} & H11_{OTT_3}^{l,m} H11_{OTT_1}^{l,m} H12_{OTT_0}^{l,m} & H11_{OTT_3}^{l,m} H12_{OTT_1}^{l,m} & H12_{OTT_3}^{l,m} & 0 \\ H21_{OTT_3}^{l,m} H11_{OTT_1}^{l,m} H11_{OTT_0}^{l,m} & H21_{OTT_3}^{l,m} H11_{OTT_1}^{l,m} H12_{OTT_0}^{l,m} & H21_{OTT_3}^{l,m} H12_{OTT_1}^{l,m} & H22_{OTT_3}^{l,m} & 0 \\ H21_{OTT_1}^{l,m} H11_{OTT_0}^{l,m} & H21_{OTT_1}^{l,m} H12_{OTT_0}^{l,m} & H22_{OTT_1}^{l,m} & 0 & 0 \\ 0 & 0 & 0 & 0 & 0 \\ H21_{OTT_0}^{l,m} & H22_{OTT_0}^{l,m} & 0 & 0 & 0 \\ 0 & 0 & 0 & 0 & 0 \end{bmatrix}$$

Second, FIG. 6 illustrates the case where only 4 channels are output in the 5-1-$5_2$ tree structure. If operations 103 through 113 are performed for the 5-1-$5_2$ tree structure illustrated in FIG. 6, $Tree'_{sign}$ (0,,) and DL(0,) are generated as follows:

$$Tree'_{sign}(0,,) = \begin{bmatrix} 1 & 1 & 1 & 1 & n/a & n/a \\ 1 & 1 & -1 & -1 & n/a & n/a \\ 1 & -1 & 1 & -1 & n/a & n/a \end{bmatrix},$$

$$DL(0,) = [\,3\ \ 3\ \ 3\ \ 3\ \ -1\ \ -1\,].$$

Decoding is thus stopped in a module before the dotted lines by the generated DL(0,).

Figure 7:
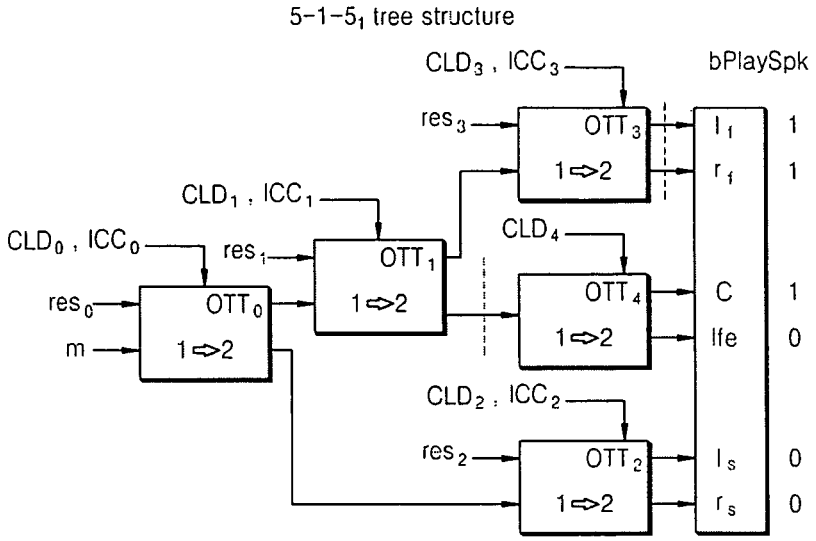
FIG. 7 illustrates 3 channels being output in a 5-1-$5_1$ tree structure, according to an embodiment of the present invention.

FIG. 7 illustrates the case where only 3 channels are output in the 5-1-$5_1$ tree structure. In this case, after operations 103 through 113 are performed, $Tree'_{sign}$(0,,) and DL(0,) are generated as follows:

$$Tree'_{sign}(0,,) = \begin{bmatrix} 1 & 1 & 1 & n/a & n/a & n/a \\ 1 & 1 & -1 & n/a & n/a & n/a \\ 1 & -1 & n/a & n/a & n/a & n/a \end{bmatrix},$$

$$DL(0,) = [\,3\ \ 3\ \ 2\ \ -1\ \ -1\ \ -1\,].$$

Decoding is thus stopped in the module before the dotted lines by the generated DL(0,).

Figure 8:
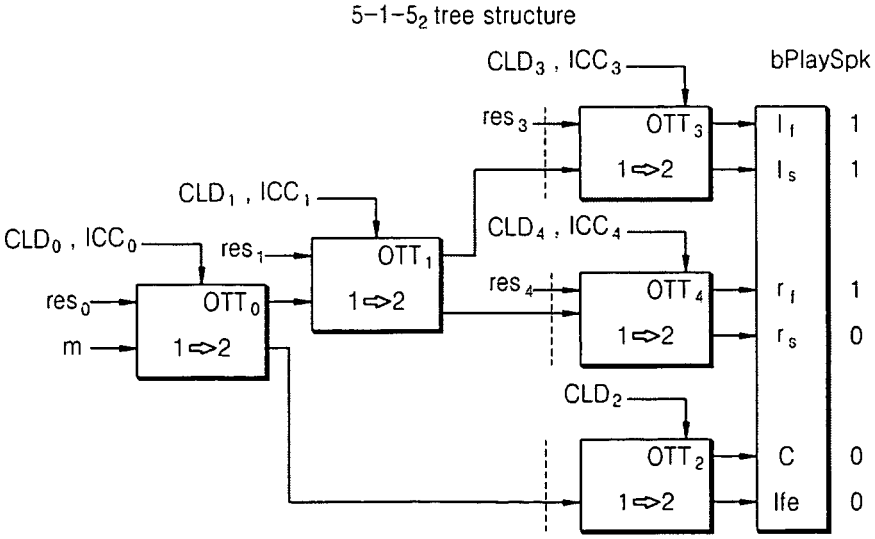
FIG. 8 illustrates 3 channels being output in a 5-1-$5_2$ tree structure, according to an embodiment of the present invention.

FIG. 8 illustrates the case where only 3 channels are output in the 5-1-$5_2$ tree structure. In this case, after operations 103 through 113 are performed, $Tree'_{sign}$(0,,) and DL(0,) are generated as follows:

$$Tree'_{sign}(0,,) = \begin{bmatrix} 1 & n/a & 1 & n/a & -1 & n/a \\ 1 & n/a & -1 & n/a & n/a & n/a \\ n/a & n/a & n/a & n/a & n/a & n/a \end{bmatrix},$$

$$DL(0,) = [\,2\ \ -1\ \ 2\ \ -1\ \ 1\ \ -1\,].$$

Here, decoding is stopped in the module before the dotted lines by the generated DL(0,).

For further example application to a 5-2-5 tree structure, a 7-2-$7_1$ tree structure, and a 7-2-$7_2$ tree structure, the corresponding $Tree_{sign}$ and $Tree_{depth}$ can also be defined.

First, in the 5-2-5 tree structure, $Tree_{sign}$, $Tree_{depth}$, and $R_1$ may be defined as follows:

$$Tree_{sign}(0,,) = Tree_{sign}(1,,) = Tree_{sign}(2,,) = [\,1\ \ -1\,],$$

$$Tree_{depth}(0,) = Tree_{depth}(1,) = Tree_{depth}(2,) = [\,1\ \ 1\,].$$

$$R_1^{l,m}(i,\ j) = 0,\ \text{when} \sum_{k=0}^{1} DL(i-3,k)\ != 2,$$

$$\text{for } 3 \le i < 6,\ 0 \le j < 3$$

Second, in the 7-2-$7_1$ tree structure, $Tree_{sign}$, $Tree_{depth}$, and $R_1$ may be defined as follows:

$$Tree_{sign}(0,,) = Tree_{sign}(1,,) = \begin{bmatrix} 1 & 1 & -1 \\ 1 & -1 & n/a \end{bmatrix},$$

-continued $$Tree_{sign}(2,,) = [\,1\ \ -1\,]$$

$$Tree_{depth}(0,,) = Tree_{depth}(1,) = [\,2\ \ 2\ \ 1\,]$$

$$Tree_{depth}(2,) = [\,1\ \ 1\,]$$

$$R_1^{l,m}(i,\ j) = 0,\ \text{when} \sum_{k=0}^{2} DL(i-3,k) < 1,$$

$$\text{for } 3 \le i < 5,\ 0 \le j < 3$$

$$R_1^{l,m}(5,\ j) = 0,\ \text{when} \sum_{k=0}^{1} DL(2,k)\ != 2,$$

$$\text{for } 0 \le j < 3$$

$$R_1^{l,m}(i,\ j) = 0,\ \text{when} \sum_{k=t1}^{t2} DL(i-6,k)\ != 4,$$

$$\text{for } 6 \le i < 8,\ 0 \le j < 3$$

|, where $t1 = 0$, $t2 = 1$ for 7-2-$7_1$ configuration $t1 = 1$, $t2 = 2$ for 7-2-$7_2$ configuration Third, in the 7-2-$7_1$ tree structure, $Tree_{sign}$, $Tree_{depth}$ and $R_1$ may be defined as follows:

$$|\ Tree_{sign}(0,,) = Tree_{sign}(1,,) = \begin{bmatrix} -1 & 1 & 1 \\ n/a & 1 & 1 \end{bmatrix},$$

$$Tree_{sign}(2,,) = [\,1\ \ -1\,]$$

$$Tree_{depth}(0,) = Tree_{depth}(1,) = [\,1\ \ 2\ \ 2\,],\ |$$

$$Tree_{depth}(2,) = [\,1\ \ 1\,]$$

$$R_1^{l,m}(i,\ j) = 0,\ \text{when} \sum_{k=0}^{2} DL(i-3,k) < 1,$$

$$\text{for } 3 \le i < 5,\ 0 \le j < 3$$

$$R_1^{l,m}(5,\ j) = 0,\ \text{when} \sum_{k=0}^{1} DL(2,k)\ != 2,$$

$$\text{for } 0 \le j < 3$$

$$R_1^{l,m}(i,\ j) = 0,\ \text{when} \sum_{k=t1}^{t2} DL(i-6,k)\ != 4,$$

$$\text{for } 6 \le i < 8,\ 0 \le j < 3$$

, where $t1 = 0$, $t2 = 1$ for 7-2-$7_1$ configuration $t1 = 1$, $t2 = 2$ for 7-2-$7_2$ configuration Each of the 5-2-5 tree structure and the 7-2-7 tree structures can be divided into three sub trees. Thus, the matrix $R_2$ can be obtained in operation 123 using the same technique as applied to the 5-1-5 tree structure.

In operation 126, the matrix $R_2$ generated in operation 123 may be interpolated in order to generate a matrix $M_2$.

In operation 129, a residual coded signal obtained by coding a down-mixed signal and the original signal using AAC (Advanced Audio Coding) in the encoder may be decoded.

An MDCT coefficient decoded in operation 129 may further be transformed into a QMF domain in operation 130.

In operation 133, overlap-add between frames may be performed for a signal output in operation 130.

Further, since a low-frequency band signal has a low frequency resolution only with QMF filterbank, additional filtering may be performed on the low-frequency band signal in order to improve the frequency resolution in operation 136.

Still further, in operation 140, an input signal may be split according to frequency bands using QMF Hybrid analysis filter bank.

In operation 143, a direct signal and a signal to be decorrelated may be generated using the matrix $M_1$ generated in operation 120.

In operation 146, decorrelation may be performed on the generated signal to be decorrelated such that the generated signal can be reconstructed to have a sense of space.

In operation 148, the matrix $M_2$ generated in operation 126 may be applied to the signal decorrelated in operation 146 and the direct signal generated in operation 143.

In operation 150, temporal envelope shaping (TES) may be applied to the signal to which the matrix $M_2$ is applied in operation 148.

In operation 153, the signal to which TES is applied in operation 150 may be transformed into a time domain using QMF hybrid synthesis filter bank.

In operation 156, temporal processing (TP) may be applied to the signal transformed in operation 153.

Here, operations 153 and 156 may be performed to improve sound quality for a signal in which a temporal structure is important, such as applause, and may be selectively performed.

In operation 158, the direct signal and the decorrelated signal may thus be mixed.

Accordingly, a matrix $R_3$ may be calculated and applied to an arbitrary tree structure using the following equation:

$$Tree_{depth}(v, i) = \begin{cases} DL(v, i), & Tree_{depth}(v, i) > DL(v, i), \\ Tree_{depth}(v, i), & \text{otherwise} \end{cases}$$

for $0 \le i < Tree_{outchan}(v)$, $0 \le v < numOutChan$ $$R_g^{l,m}(i, v) = \begin{cases} Tree_{depth} \prod_{\rho=0}^{(i-i_{offset}(v))-1} X_{Tree(r,\rho,i-i_{offset}(v))}, & \text{if } i_{offset}(v) \le i < i_{offset}(v) + Tree_{outChan}(v), \; Tree_{depth}(v, i - i_{offset}(v)) > 0 \\ 1, & \text{else if } Tree_{depth}(v, i - i_{offset}(v)) = 0 \\ 0, & \text{otherwise} \end{cases}$$

-continued for $0 \le i < numChanOutAT$ and $0 \le v < numOutChan$ where $$i_{offset}(v) = \begin{cases} \sum_{k=0}^{v-1} Tree_{outChan}(k), & v > 0 \\ 0 & \text{otherwise} \end{cases} \quad \text{and}$$

$$X_{Tree(r,\rho,i_{imp})} = \begin{cases} c_{l,Mz(r,\rho,i_{imp})}, & Tree_{sign}(v, pi_{imp}) = 1 \\ c_{r,Mz(r,\rho,i_{imp})}, & Tree_{sign}(v, pi_{imp}) = -1 \end{cases}$$

where $$idx(v, p, i_{imp}) = \begin{cases} \sum_{k=0}^{r-1} (Tree_{outChan}(k)) + Tree(v, p, i_{imp}), & v > 0 \\ Tree(v, p, i_{imp}) & \text{otherwise} \end{cases}$$

and where $$c_{l,X} = \sqrt{\frac{CLD_{1\text{In},X}^2}{1 + CLD_{\text{In},X}^2}}$$

and $c_{r,X} = \sqrt{\frac{1}{1 + CLD_{1\text{In},X}^2}}$, where $CLD_{1\text{In},X} = 10^{-\frac{CLD_X}{20}}$ and where $CLD_x^{l,m} = D_{ATD}(X, l, m)$, $0 \le m < M$, $0 \le l < L$.

Figure 2:
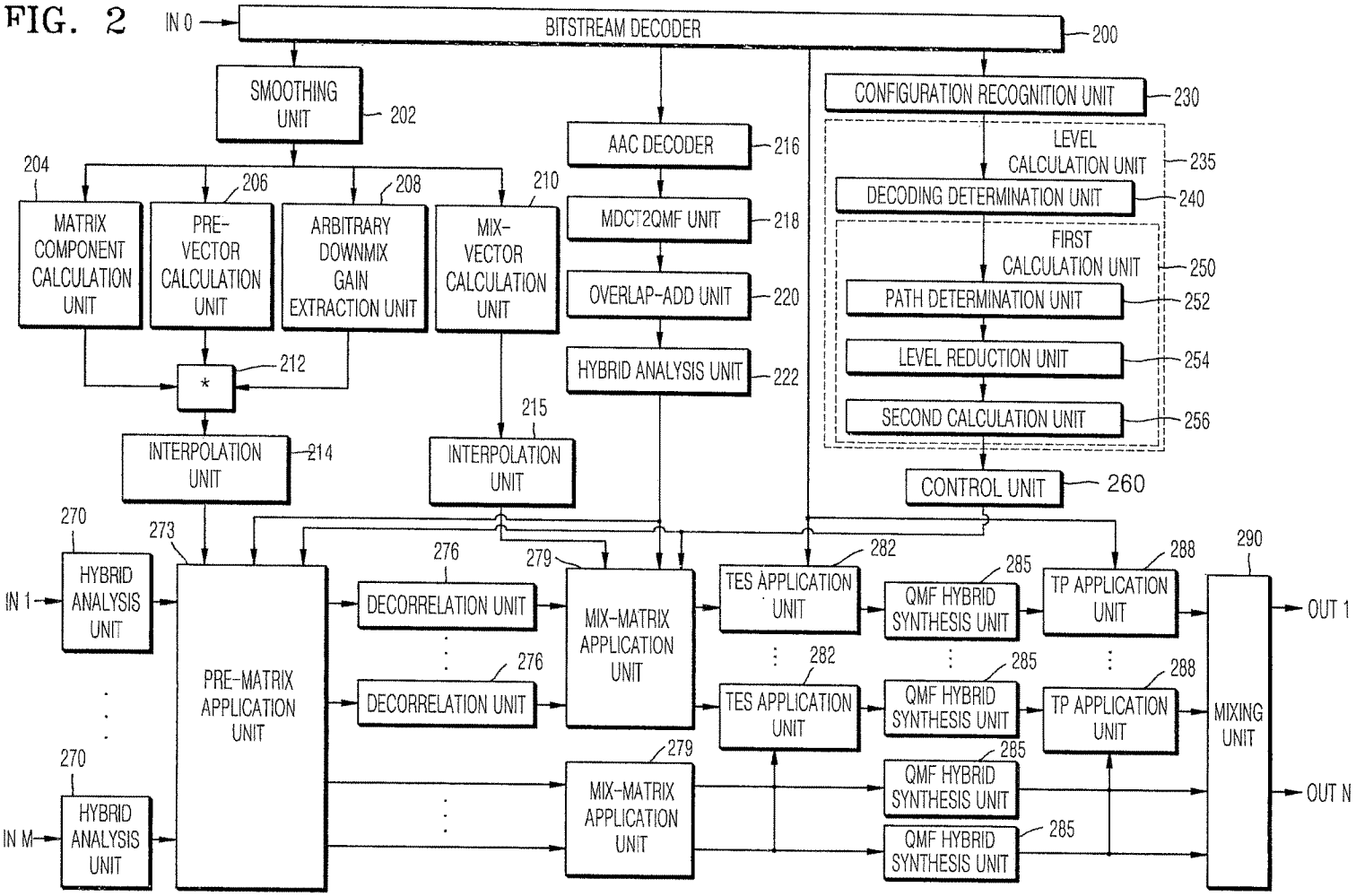
FIG. 2 illustrates an apparatus with scalable channel decoding, according to an embodiment of the present invention.
Figure 3:
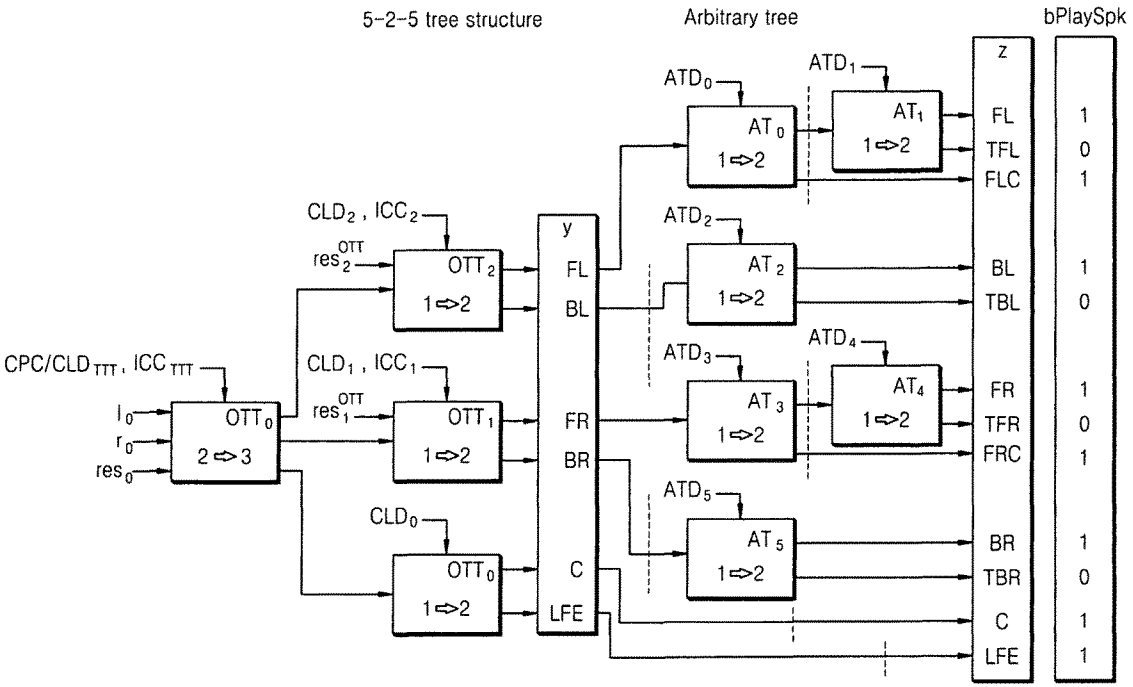
FIG. 3 illustrates a complex structure of a 5-2-5 tree structure and an arbitrary tree structure, according to an embodiment of the present invention.

FIG. 2 illustrates an apparatus with scalable channel decoding, according to an embodiment of the present invention.

A bitstream decoder 200 may thus parse a surround bitstream transmitted from an encoder to extract spatial cues and additional information.

Similar to above, a configuration recognition unit 230 may recognize the configuration of channels or speakers provided/available in/to a decoder. The configuration of multi-channels in the decoder corresponds to the number of speakers included/available in/to the decoder (i.e., the aforementioned numPlayChan), the positions of operable speakers among the speakers included/available in/to the decoder (i.e., the aforementioned playChanPos(ch)), and a vector indicating whether a channel encoded in the encoder is available in the multi-channels provided in the decoder (i.e., the aforementioned bPlaySpk(ch)).

Here, bPlaySpk(ch) expresses, among channels encoded in the encoder, a channel that is available in multi-channels provided in the decoder using a '1' and a channel that is not available in the multi-channels using '0', according to the aforementioned Equation 1, repeated below.

$$bPlaySpk(i) = \begin{cases} 1, & \text{if the loudspeaker positon of } i^{th} \text{output channel} \in playChanPos \\ 0, & \text{otherwise} \end{cases} \qquad \text{Equation 1}$$

for $0 \le i \le numOutChanAT$

Again, the referenced numOutChanAT may be calculated according to the aforementioned Equation 2, repeated below.

$$numOutChaAT = \sum_{k=0}^{numOutChan-1} Tree_{OutChan}(k) \quad \text{Equation 2}$$

Similarly, the referenced playChanPos may be, again, expressed for, e.g., a 5.1 channel system, according to the aforementioned Equation 3, repeated below.

playChanPos=[FL FR C LFE BL BR] Equation 3:

A level calculation unit 235 may calculate the number of decoding levels for each multi-channel signal, e.g., using the configuration of multi-channels recognized by the configuration recognition unit 230. Here, the level calculation unit 235 may include a decoding determination unit 240 and a first calculation unit 250, for example.

The decoding determination unit 240 may determine not to decode a channel, among channels encoded in the encoder, e.g., which may not be available in multi-channels, using the recognition result of the configuration recognition unit 230.

Thus, the aforementioned matrix $Tree_{sign}(v,)$ may include components indicating whether each output signal is to be output to an upper level of an OTT module (in which case, the component may be expressed with a '1') or whether each output signal is to be output to a lower level of the OTT module (in which case the component is expressed with a '−1'), e.g., as in tree structures illustrated in FIGS. 3 through 8. In the matrix $Tree_{sign}(v,)$, v is greater than 0 and less than numOutChan. As noted above, embodiments of the present invention have been described using this matrix $Tree_{sign}(v,)$, but it can be understood by those skilled in the art that embodiments of the present invention can be implemented without being limited to such a matrix $Tree_{sign}(v,)$. For example, a matrix that is obtained by exchanging rows and columns of the matrix $Tree_{sign}(v,)$ may equally be used, for example.

Again, as an example, in a tree structure illustrated in FIG. 4, in a matrix $Tree_{sign}$, a first column to be output to an upper level from Box 0, an upper level from Box 1, and an upper level from Box 2 is indicated by [1 1 1], and a fourth column to be output to a lower level from Box 0 and an upper level from Box 3 is indicated by [−1 1 n/a]. Here, 'n/a' is an identifier indicating a corresponding channel, module, or box is not available. In this way, all multi-channels can be expressed with $Tree_{sign}$ as follows:

$$Tree_{sign} = \begin{pmatrix} 1 & 1 & 1 & -1 & -1 & -1 \\ 1 & 1 & -1 & 1 & -1 & -1 \\ 1 & -1 & n/a & n/a & 1 & -1 \end{pmatrix}$$

Thus, the decoding determination unit 240 may set a column corresponding to a channel that is not available in the multi-channels, for example as provided in the decoder, among the channels encoded in the encoder, to 'n/a' in the matrix $Tree_{sign}$.

For example, in the tree structure illustrated in FIG. 4, the vector bPlaySpk, indicating whether a channel encoded in the encoder is available in the multi-channels provided in the decoder, is expressed with a '0' in a second channel and a fourth channel. Thus, the second channel and the fourth channel among the multi-channels provided in the decoder are not available in the multi-channels provided in the decoder. Thus, the decoding determination unit 240 may set a second column and a fourth column corresponding to the second channel and the fourth channel to n/a in the matrix $Tree_{sign}$, thereby generating $Tree'_{sign}$.

$$Tree'_{sign} = \begin{pmatrix} 1 & n/a & 1 & n/a & -1 & -1 \\ 1 & n/a & -1 & n/a & -1 & -1 \\ 1 & n/a & n/a & n/a & 1 & -1 \end{pmatrix}$$

The first calculation unit 250 may further determine whether there are multi-channels to be decoded in the same path, except for the channel that is determined not to be decoded by the decoding determination unit 240, for example, in order to calculate the number of decoding levels. Here, the decoding level indicates the number of modules or boxes for decoding, like an OTT module or a TTT module, through which a signal has to pass to be output from each of the multi-channels.

The first calculation unit 250 may, thus, include a path determination unit 252, a level reduction unit 254, and a second calculation unit 256, for example.

The path determination unit 252 may determine whether there are multi-channels to be decoded in the same path, except for the channel that is determined not to be decoded by the decoding determination unit 240. The path determination unit 252 determines whether $Tree_{sign}(v,0:i-1,j)$ and $Tree_{sign}(v,0:i-1,k)$ are the same in order to determine whether there are multi-channels to be decoded in the same path on the assumption that predetermined integers j and k are not equal in a matrix $Tree_{sign}(v,i,j)$ set by the decoding determination unit 240.

For example, in the tree structure illustrated in FIG. 4, since $Tree_{sign}(v,0:1,1)$ and $Tree_{sign}(v,0:1,3)$ are not the same, the path determination unit 252 may determine a first channel and a third channel in the matrix $Tree'_{sign}$ as multi-channels that are not to be decoded in the same path. However, since $Tree_{sign}$ (v,0:1,5) and $Tree_{sign}(v,0:1,6)$ are the same, the path determination unit 252 may determine a fifth channel and a sixth channel in the matrix $Tree'_{sign}$ as multi-channels that are to be decoded in the same path.

The level reduction unit 254 may reduce a decoding level for channels that are determined, e.g., by the path determination unit 252, as multi-channels that are not to be decoded in the same path. Here, the decoding level indicates the number of modules or boxes for decoding, like an OTT module or a TTT module, through which a signal has to pass to be output from each of the multi-channels. A decoding level that is finally determined, e.g., by the path determination unit 252, for channels determined as multi-channels that are not to be decoded in the same path is expressed as n/a.

Again, as an example, in the tree structure illustrated in FIG. 4, since the first channel and the third channel are determined to be multi-channels that are not to be decoded in the same path, the last row of a first column corresponding to the first channel and the last row of a third column corresponding to the third channel are set to n/a as follows:

$$Tree'_{sign} = \begin{pmatrix} 1 & n/a & 1 & n/a & -1 & -1 \\ 1 & n/a & -1 & n/a & -1 & -1 \\ n/a & n/a & n/a & n/a & 1 & -1 \end{pmatrix}$$

Thus, the path determination unit 252 and the level reduction unit 254 may repeat operations while reducing the decoding level one-by-one. Accordingly, the path determination unit 252 and the level reduction unit 254 may repeat operations from the last row to the first row of $Tree_{sign}(v,)$ on a row-by-row basis, for example.

The level calculation unit 235 sets $Tree_{sign}(v,)$ for each sub-tree using a pseudo code illustrated in FIG. 9.

Further, the second calculation unit 256 may calculate the number of decoding levels for each of the multi-channels, e.g., using the result obtained by the level reduction unit 254. Here, the second calculation unit 256 may calculate the number of decoding levels, as discussed above and repeated below, as follows:

$$DL(v) = \left[dl_{i_{offset}(v)}\, dl_{i_{offset}(v)+1} \cdots dl_{i_{offset}(v)+Tree_{outChan}(v)-1}\right] \text{ where}$$

$$i_{offset}(v) = \begin{cases} \sum_{k=0}^{v-1} Tree_{outChan}(k), & v > 0 \\ 0 & \text{otherwise} \end{cases}, \quad 0 <= v < numOutChan$$

$$dl_{i_{offset}(v)+i} = \begin{cases} \sum_{j=0}^{Tree_{depth}(v,i)-1} \text{abs}(Tree_{sign}(v, j, i)), & \text{if } bPlaySpk[i] \text{ is equal to } 1 \\ -1, & \text{otherwise} \end{cases},$$

for $0 \le i < Tree_{outChan}(v)$, $0 \le v < numOutChan$ where $\text{abs}(n/a) = 0$, $$i_{offset}(v) = \begin{cases} \sum_{k=0}^{v-1} Tree_{outChan}(k), & v > 0 \\ 0 & \text{otherwise} \end{cases}$$

For example, in the tree structure illustrated in FIG. 4, the number of decoding levels of the matrix $Tree'_{sign}$ may be set by the level reduction unit 254 and may be calculated according to the repeated:

DL=[2 −1 2 −1 3 3]

Since, in this embodiment, the absolute value of n/a may be assumed to be 0 and a column whose components are all n/a may be assumed to be −1, the sum of absolute values of components of the first column in the matrix $Tree'_{sign}$ is 2 and the second column whose components are all n/a in the matrix $Tree'_{sign}$ is set to −1.

By using the aforementioned DL, calculated as described above, modules before the dotted line illustrated in FIG. 4 may perform decoding, thereby implementing scalable decoding.

A control unit 260 may control generation of the aforementioned matrices $R_1$, $R_2$, and $R_3$ in order for an unnecessary module to not perform decoding, e.g., using the decoding level calculated by the second calculation unit 256.

A smoothing unit 202 may selectively smooth the extracted spatial cues, e.g., extracted by the bitstream decoder 200, in order to prevent a sharp change in the spatial cues at low bitrates.

For compatibility with a conventional matrix surround method, a matrix component calculation unit 204 may calculate a gain for each additional channel.

A pre-vector calculation unit 206 may further calculate pre-vectors.

An arbitrary downmix gain extraction unit 208 may extract a parameter for compensating for a gain for each channel in the case an external downmix is used at the decoder.

A matrix generation unit 212 may generate a matrix $R_1$, e.g., using the results output from the matrix component calculation unit 204, the pre-vector calculation unit 206, and the arbitrary downmix gain extraction unit 208. The matrix $R_1$ can be used for generation of a signal to be input to a decorrelator for decorrelation.

Again, as an example, the 5-1-$5_1$ tree structure illustrated in FIG. 5 and the 5-1-$5_2$ tree structure illustrated in FIG. 6 may be set to the aforementioned matrices, repeated below.

$$\text{Tree}(0, ,) = \begin{bmatrix} 0 & 0 & 0 & 0 & 0 & 0 \\ 1 & 1 & 1 & 1 & 2 & 2 \\ 3 & 3 & 4 & 4 & n/a & n/a \end{bmatrix},$$

$$Tree_{sign}(0, ,) = \begin{bmatrix} 1 & 1 & 1 & 1 & -1 & -1 \\ 1 & 1 & -1 & -1 & 1 & -1 \\ 1 & -1 & 1 & -1 & n/a & n/a \end{bmatrix},$$

$$Tree_{depth}(0,) = [3\ \ 3\ \ 3\ \ 3\ \ 2\ \ 2],$$

$$Tree_{outChan}(0) = [6].$$

In the 5-1-$5_1$ tree structure, the matrix generation unit 212, for example, $R_1$, discussed above and repeated below.

$$R_1^{l,m} = \begin{bmatrix} 1 \\ 1 \\ K1 \\ K2 \\ K3 \end{bmatrix}, \text{ where } \quad K1 = \begin{cases} c_{1,OTT_0}^{l,m}, & \sum_{i=0}^{3} DL(0, i) \,!= -4 \\ 0, & \text{otherwise} \end{cases}$$

$$K2 = \begin{cases} c_{1,OTT_0}^{l,m} c_{1,OTT_1}^{l,m}, & DL(0, 0) = 3, DL(0, 1) = 3, \\ 0, & \text{otherwise} \end{cases}$$

$$K3 = \begin{cases} c_{2,OTT_0}^{l,m}, & DL(0, 4) = 2, DL(0, 5) = 2 \\ 0, & \text{otherwise} \end{cases}$$

-continued

, where $$c_{1,OTT_X}^{l,m} = \sqrt{\frac{10^{\frac{CLD_X^{l,m}}{10}}}{1+10^{\frac{CLD_X^{l,m}}{10}}}} \text{ and } c_{2,OTT_X}^{l,m} = \sqrt{\frac{1}{1+10^{\frac{CLD_X^{l,m}}{10}}}}, \text{ |}$$

and where:

$$CLD_X^{l,m} = D_{CLD}(X, l, m), 0 \le X < 2, 0 \le m < M_{proc}, 0 \le l < L.$$

In this case, in the 5-1-$5_2$ tree structure, the matrix generation unit 212 may generate the matrix $R_1$, again, as follows:

$$R_1^{l,m} = \begin{bmatrix} 1 \\ 1 \\ K1 \\ K2 \\ K3 \end{bmatrix}, \text{ where } \begin{array}{l} K1 = \begin{cases} c_{1,OTT_0}^{l,m}, & \sum_{i=0}^{3} DL(0, i) \,!= -4 \\ 0, & \text{otherwise} \end{cases} \\ K2 = \begin{cases} c_{1,OTT_0}^{l,m} c_{1,OTT_1}^{l,m}, & DL(0, 0) = 3, DL(0, 1) = 3, \\ 0, & \text{otherwise} \end{cases} \\ K3 = \begin{cases} c_{1,OTT_0}^{l,m} c_{2,OTT_1}^{l,m}, & DL(0, 2) = 3, DL(0, 3) = 3 \\ 0, & \text{otherwise} \end{cases} \end{array}$$

$$\text{, where } c_{1,OTT_X}^{l,m} = \sqrt{\frac{10^{\frac{CLD_X^{l,m}}{10}}}{1+10^{\frac{CLD_X^{l,m}}{10}}}} \text{ and } c_{2,OTT_X}^{l,m} = \sqrt{\frac{1}{1+10^{\frac{CLD_X^{l,m}}{10}}}},$$

and where:

$$CLD_X^{l,m} = D_{CLD}(X, l, m), 0 \le X < 2, 0 \le m < M_{proc}, 0 \le l < L$$

An interpolation unit 214 may interpolate the matrix $R_1$, e.g., as generated by the matrix generation unit 212, in order to generate the matrix $M_1$.

A mix-vector calculation unit 210 may generate the matrix $R_2$ for mixing a decorrelated signal with a direct signal.

The matrix $R_2$ generated by the mix-vector calculation unit 210 removes a component of a matrix or of a vector corresponding to the unnecessary module, e.g., determined by the level calculation unit 235, using the aforementioned pseudo code illustrated in FIG. 10.

An interpolation unit 215 may interpolate the matrix $R_2$ generated by the mix-vector calculation unit 210 in order to generate the matrix $M_2$.

Similar to above, examples for application to the 5-1-$5_1$ tree structure and the 5-1-$5_2$ tree structure will be described again.

First, FIG. 5 illustrates the case where only 4 channels are output in the 5-1-$5_1$ tree structure. Here, $Tree'_{sign}$ (0,,) and DL(0,) may be generated by the level calculation unit 235 as follows:

$$Tree'_{sign}(0, ,) = \begin{bmatrix} 1 & 1 & 1 & n/a & -1 & n/a \\ 1 & 1 & -1 & n/a & n/a & n/a \\ 1 & -1 & n/a & n/a & n/a & n/a \end{bmatrix},$$

$$DL(0,) = [\,3 \;\; 3 \;\; 2 \;\; -1 \;\; 1 \;\; -1\,].$$

Decoding may be stopped in a module before the dotted line by the generated DL(0,). Thus, since OTT2 and OTT4 do not perform up-mixing, the matrix $R_2$ may be generated, e.g., by the mix-vector calculation unit 210, again as follows:

$$R_2^{l,m} = \begin{bmatrix} H11_{OTT_3}^{l,m} H11_{OTT_1}^{l,m} H11_{OTT_0}^{l,m} & H11_{OTT_3}^{l,m} H11_{OTT_1}^{l,m} H12_{OTT_0}^{l,m} & H11_{OTT_3}^{l,m} H12_{OTT_1}^{l,m} & H12_{OTT_3}^{l,m} & 0 \\ H21_{OTT_3}^{l,m} H11_{OTT_1}^{l,m} H11_{OTT_0}^{l,m} & H21_{OTT_3}^{l,m} H11_{OTT_1}^{l,m} H12_{OTT_0}^{l,m} & H21_{OTT_3}^{l,m} H12_{OTT_1}^{l,m} & H22_{OTT_3}^{l,m} & 0 \\ H21_{OTT_1}^{l,m} H11_{OTT_0}^{l,m} & H21_{OTT_1}^{l,m} H12_{OTT_0}^{l,m} & H22_{OTT_1}^{l,m} & 0 & 0 \\ 0 & 0 & 0 & 0 & 0 \\ H21_{OTT_0}^{l,m} & H22_{OTT_0}^{l,m} & 0 & 0 & 0 \\ 0 & 0 & 0 & 0 & 0 \end{bmatrix}$$

Second, FIG. 6 illustrates the case where only 4 channels are output in the 5-1-$5_2$ tree structure. Here, $Tree'_{sign}(0,,)$ and DL(0,) may be generated, e.g., by the level calculation unit 235, as follows:

$$Tree'_{sign}(0,,) = \begin{bmatrix} 1 & 1 & 1 & 1 & n/a & n/a \\ 1 & 1 & -1 & -1 & n/a & n/a \\ 1 & -1 & 1 & -1 & n/a & n/a \end{bmatrix},$$

$$DL(0,) = [\,3\ \ 3\ \ 3\ \ 3\ \ -1\ \ -1\,].$$

Decoding is stopped in a module before a dotted line by the generated DL(0,).

FIG. 7 illustrates a case where only 3 channels can be output in the 5-1-$5_1$ tree structure. $Tree'_{sign}(0,,)$ and DL(0,) are generated by the level calculation unit 235 as follows:

$$Tree'_{sign}(0,,) = \begin{bmatrix} 1 & 1 & 1 & n/a & n/a & n/a \\ 1 & 1 & -1 & n/a & n/a & n/a \\ 1 & -1 & n/a & n/a & n/a & n/a \end{bmatrix},$$

$$DL(0,) = [\,3\ \ 3\ \ 2\ \ -1\ \ -1\ \ -1\,].$$

Here, decoding may be stopped in a module before the dotted line by the generated DL(0,).

FIG. 8 illustrates the case where only 3 channels are output in the 5-1-$5_2$ tree structure. Here, $Tree'_{sign}(0,,)$ and DL(0,) may be generated, e.g., by the level calculation unit 235, as follows:

$$Tree'_{sign}(0,,) = \begin{bmatrix} 1 & n/a & 1 & n/a & -1 & n/a \\ 1 & n/a & -1 & n/a & n/a & n/a \\ n/a & n/a & n/a & n/a & n/a & n/a \end{bmatrix},$$

$$DL(0,) = [\,2\ \ -1\ \ 2\ \ -1\ \ 1\ \ -1\,].$$

Here, again, decoding may be stopped in a module before the dotted line by the generated DL(0,).

For the aforementioned example application to the 5-2-5 tree structure, the 7-2-$7_1$ tree structure, and the 7-2-$7_2$ tree structure, the corresponding $Tree_{sign}$ and $Tree_{depth}$ may also be defined.

First, in the 5-2-5 tree structure, $Tree_{sign}$, $Tree_{depth}$, and $R_1$ may be defined as follows:

$$Tree_{sign}(0,,) = Tree_{sign}(1,,) = Tree_{sign}(2,,) = [\,1\ \ -1\,],$$

$$Tree_{depth}(0,) = Tree_{depth}(1,) = Tree_{depth}(2,) = [\,1\ \ 1\,].$$

$$R_1^{l,m}(i,\ j) = 0, \text{ when } \sum_{k=0}^{l} DL(i-3,k) \mathrel{!}= 2,$$

$$\text{for } 3 \le i < 6,\ 0 \le j < 3$$

Second, in the 7-2-$7_1$ tree structure, $Tree_{sign}$, $Tree_{depth}$, and $R_1$ may be defined as follows:

$$Tree_{sign}(0,,) = Tree_{sign}(1,,) = \begin{bmatrix} 1 & 1 & -1 \\ 1 & -1 & n/a \end{bmatrix},$$

-continued $$Tree_{sign}(2,,) = [\,1\ \ -1\,]$$

$$Tree_{depth}(0,) = Tree_{depth}(1,) = [\,2\ \ 2\ \ 1\,]$$

$$Tree_{depth}(2,) = [\,1\ \ 1\,]$$

$$R_1^{l,m}(i,\ j) = 0, \text{ when } \sum_{k=0}^{2} DL(i-3,k) < 1,$$

$$\text{for } 3 \le i < 5,\ 0 \le j < 3$$

$$R_1^{l,m}(5,\ j) = 0, \text{ when } \sum_{k=0}^{1} DL(2,k) \mathrel{!}= 2,$$

$$\text{for } 0 \le j < 3$$

$$R_1^{l,m}(i,\ j) = 0, \text{ when } \sum_{k=t1}^{t2} DL(i-6,k) \mathrel{!}= 4,$$

$$\text{for } 6 \le i < 8,\ 0 \le j < 3$$

|, where $t1 = 0$, $t2 = 1$ for 7-2-$7_1$configuration $t1 = 1$, $t2 = 2$ for 7-2-$7_2$configuration Third, in the 7-2-$7_1$ tree structure, $Tree_{sign}$, $Tree_{depth}$, and $R_1$ may be defined as follows:

$$Tree_{sign}(0,,) = Tree_{sign}(1,,) = \begin{bmatrix} -1 & 1 & 1 \\ n/a & 1 & 1 \end{bmatrix},$$

$$Tree_{sign}(2,,) = [\,1\ \ -1\,]$$

$$Tree_{depth}(0,) = Tree_{depth}(1,) = [\,1\ \ 2\ \ 2\,],$$

$$Tree_{depth}(2,) = [\,1\ \ 1\,]$$

$$R_1^{l,m}(i,\ j) = 0, \text{ when } \sum_{k=0}^{2} DL(i-3,k) < 1,$$

$$\text{for } 3 \le i < 5,\ 0 \le j < 3$$

$$R_1^{l,m}(5,\ j) = 0, \text{ when } \sum_{k=0}^{1} DL(2,k) \mathrel{!}= 2,$$

$$\text{for } 0 \le j < 3$$

$$R_1^{l,m}(i,\ j) = 0, \text{ when } \sum_{k=t1}^{t2} DL(i-6,k) \mathrel{!}= 4,$$

$$\text{for } 6 \le i < 8,\ 0 \le j < 3$$

, where $t1 = 0$, $t2 = 1$ for 7-2-$7_1$configuration $t1 = 1$, $t2 = 2$ for 7-2-$7_2$configuration As noted above, each of the 5-2-5 tree structure and the 7-2-7 tree structures can be divided into three sub trees. Thus, the matrix $R_2$ may be obtained by the mix-vector generation unit 210, for example, using the same technique as applied to the 5-1-5 tree structure.

An AAC decoder 216 may decode a residual coded signal obtained by coding a down-mixed signal and the original signal using ACC in the encoder.

A MDCT2QMF unit 218 may transform an MDCT coefficient, e.g., as decoded by the MC decoder 216, into a QMF domain.

An overlap-add unit 220 may perform overlap-add between frames for a signal output by the MDCT2QMF unit 218.

A hybrid analysis unit 222 may further perform additional filtering in order to improve the frequency resolution of a low-frequency band signal because the low-frequency band signal has a low frequency resolution only with QMF filterbank.

In addition, a hybrid analysis unit 270 may split an input signal according to frequency bands using QMF Hybrid analysis filter bank.

A pre-matrix application unit 273 may generate a direct signal and a signal to be decorrelated using the matrix $M_1$, e.g., as generated by the interpolation unit 214.

A decorrelation unit 276 may perform decorrelation on the generated signal to be decorrelated such that the generated signal can be reconstructed to have a sense of space.

A mix-matrix application unit 279 may apply the matrix $M_2$, e.g., as generated by the interpolation unit 215, to the signal decorrelated by the decorrelation unit 276 and the direct signal generated by the pre-matrix application unit 273.

A temporal envelope shaping (TES) application unit 282 may further apply TES to the signal to which the matrix $M_2$ is applied by the mix-matrix application unit 279.

A QMF hybrid synthesis unit 285 may transform the signal to which TES is applied by the TES application unit 282 into a time domain using QMF hybrid synthesis filter bank.

A temporal processing (TP) application unit 288 further applies TP to the signal transformed by the QMF hybrid synthesis unit 285.

Here, the TES application unit 282 and the TP application unit 288 may be used to improve sound quality for a signal in which a temporal structure is important, like applause, and may be selectively used.

A mixing unit 290 may mix the direct signal with the decorrelated signal.

The aforementioned matrix $R_3$ may be calculated and applied to an arbitrary tree structure using the aforementioned equation, repeated below:

$$Tree_{depth}(v, i) = \begin{cases} DL(v, i), & Tree_{depth}(v, i) > DL(v, i), \\ Tree_{depth}(v, i), & \text{otherwise} \end{cases}$$

for $0 \le i < Tree_{outchan}(v)$, $0 \le v < numOutChan$ $$R_g^{l,m}(i, v) = \begin{cases} Tree_{depth} \prod_{\rho=0}^{(i-i_{offset}(v))-1} X_{Tree(v,\rho,i-i_{offset}(v))}, & \text{if } i_{offset}(v) \le i < i_{offset}(v) + Tree_{outChan}(v), \; Tree_{depth}(v, i - i_{offset}(v)) > 0, \\ 1, & \text{else if } Tree_{depth}(v, i - i_{offset}(v)) = 0 \\ 0, & \text{otherwise} \end{cases}$$

for $0 \le i < numChanOutAT$ and $0 \le v < numOutChan$ where $$i_{offset}(v) = \begin{cases} \sum_{k=0}^{v-1} Tree_{outChan}(k), & v > 0 \text{ and} \\ 0 & \text{otherwise} \end{cases}$$

$$X_{Tree(r,\rho,i_{imp})} = \begin{cases} C_{l,M_2(r,\rho,i_{imp})}, & Tree_{sign}(v, pi_{imp}) = 1 \\ C_{r,M_2(r,\rho,i_{imp})}, & Tree_{sign}(v, pi_{imp}) = -1 \end{cases}$$

-continued where $$idx(v, p, i_{imp}) = \begin{cases} \sum_{k=0}^{r-1} (Tree_{outChan}(k)) + Tree(v, p, i_{imp}), & v > 0 \\ Tree(v, p, i_{imp}) & \text{otherwise} \end{cases}$$

and where $$C_{l,X} = \sqrt{\frac{CLD_{1\ln,X}^2}{1 + CLD_{1\ln,X}^2}}$$

and $C_{r,X} = \sqrt{\frac{1}{1 + CLD_{1\ln,X}^2}}$, where $CLD_{1\ln,X} = 10^{\frac{CLD_X}{20}}$ and where $$CLD_x^{l,m} = D_{ATD}(X, l, m), 0 \le m < M, 0 \le l < L.$$

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDS), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

According to an embodiment of the present invention, a configuration of channels or speakers provided/available in/to a decoder may be recognized to calculate the number of decoding levels for each multi-channel signal, such that decoding and up-mixing can be performed according to the calculated number of decoding levels.

In this way, it is possible to reduce the number of output channels in the decoder and complexity in decoding. Moreover, the optimal sound quality can be provided adaptively according to the configuration of various speakers of users.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for scalable channel decoding, the method comprising:

decoding two down-mixed signals and a first residual signal into first, second and third channel signals, based on two-to-three (TTT) spatial information;

decoding the first channel signal and a second residual signal into first plural channel signals, based on first one-to-two (OTT) spatial information;

decoding the second channel signal and a third residual signal into second plural channel signals, based on second OTT spatial information;

decoding the third channel signal into third plural channel signals, based on third OTT spatial information;

decoding one of the first plural channel signals and a fourth residual signal into fourth plural channel signals, based on fourth OTT spatial information; and decoding one of the second plural channel signals and a fifth residual signal into fifth plural channel signals, based on fifth OTT spatial information, wherein the decoding one of the first plural channel signals and the fourth residual signal and the decoding one of the second plural channel signals and the fifth residual signal are selectively performed such that either a 7.1 channel output or a 5.1 channel output is generated, wherein if the 5.1 channel output is generated, the fourth OTT spatial information and the fourth residual signal and the fifth OTT spatial information and the fifth residual signal are not used, and wherein the TTT spatial information and the first to the fifth OTT spatial information are obtained from a bitstream.

2. The method of claim 1, wherein the TTT spatial information and the first to the fifth OTT spatial information comprises information of magnitude differences and/or similarities between corresponding channels.

3. At least one non-transitory computer readable recording medium comprising computer readable code to control at least one processing element to implement the method of claim 1.

4. An apparatus with scalable channel decoding, the apparatus comprising:

a two-to-three (TTT) decoder configured to decode two down-mixed signals and a first residual signal into first, second and third channel signals, based on TTT spatial information;

a first one-to-two (OTT) decoder configured to decode the first channel signal and a second residual signal into first plural channel signals, based on first OTT spatial information;

a second OTT decoder configured to decode the second channel signal and a third residual signal into second plural channel signals, based on second OTT spatial information;

a third OTT decoder configured to decode the third channel signal into third plural channel signals, based on third OTT spatial information;

a fourth OTT decoder configured to decode one of the first plural channel signals and a fourth residual signal into fourth plural channel signals, based on fourth OTT spatial information; and a fifth OTT decoder configured to decode one of the second plural channel signals and a fifth residual signal into fifth plural channel signals, based on fifth OTT spatial information, wherein the fourth OTT decoder and the fifth OTT decoder are configured to perform selective decoding such that either a 7.1 channel output or a 5.1 channel output is generated, wherein if the 5.1 channel output is generated, the fourth OTT spatial information and the fourth residual signal and the fifth OTT spatial information and the fifth residual signal are not used, and wherein the TTT spatial information and the first to the fifth OTT spatial information are obtained from a bitstream.

5. The apparatus of claim 4, wherein the TTT spatial information and the first to the fifth OTT spatial information comprises information of magnitude differences and/or similarities between corresponding channels.

* * * * *